United States Patent [19]

Bertiller et al.

[11] Patent Number: 4,955,300

[45] Date of Patent: Sep. 11, 1990

[54] ADAPTIVE CARTRIDGE FOR A SUBCALIBER BARREL SYSTEM

[75] Inventors: Roland Bertiller, Schramberg; Roland Maier, Staig-Altheim, both of Fed. Rep. of Germany

[73] Assignee: Mauser-Werke Oberndorf GmbH, Oberndorf, Fed. Rep. of Germany

[21] Appl. No.: 428,196

[22] Filed: Oct. 27, 1989

[30] Foreign Application Priority Data

Oct. 27, 1988 [DE] Fed. Rep. of Germany ..... 3836529

[51] Int. Cl.[5] ..... F42B 8/10; F41A 21/10

[52] U.S. Cl. ..... 102/446; 102/472; 42/84

[58] Field of Search ..... 102/444, 446, 447, 472; 42/77, 84

[56] References Cited

U.S. PATENT DOCUMENTS 4,404,765 9/1983 Reudelsterz et al. ..... 102/446

4,620,485 11/1986 Bertiller ..... 102/446

*Primary Examiner*—Charles T. Jordan

*Assistant Examiner*—Michael J. Carone

*Attorney, Agent, or Firm*—McGlew & Tuttle, P.C.

[57] ABSTRACT

The invention provides an electrical igniter for an adaptive cartridge of a subcaliber barrel system by which the firing pin extension (12) is arranged axially movable by means of a guide (13) made of an electrically non-conductive material. A slide valve (22) grips a safety rod (17) in the guide (13). The safety rod (17) is situated adjacent the breech mechanism (6) only such that the firing pin (12) borders on the percussion cap (29) of the cartridge (11). By an open breech mechanism (6) the safety rod (17), under spring tension, is moved in the direction of the cartridge (11) together with the firing pin (12).

5 Claims, 1 Drawing Sheet

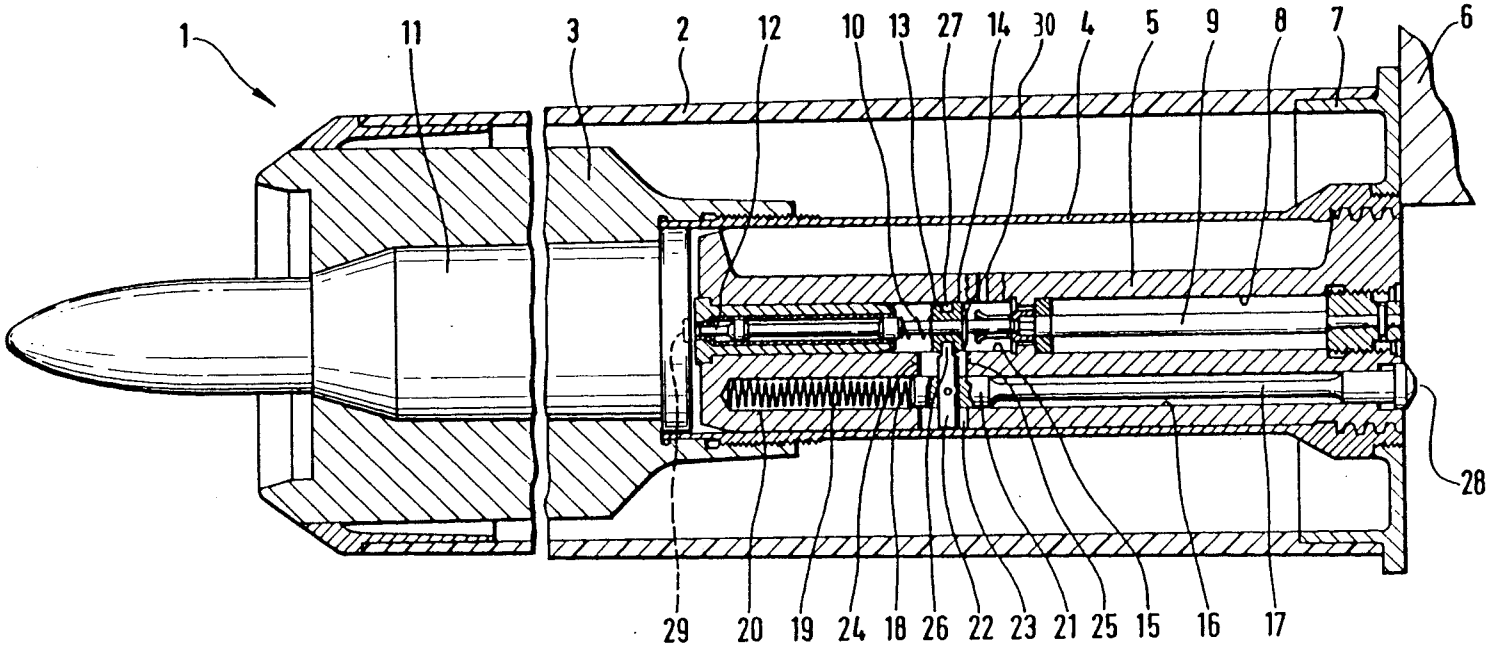
6
7
8
9
5
4
30
14
27
13
10
12
2
3
11
1
28
17
16
15
25
21
23
22
26
18
24
19
20
29

ADAPTIVE CARTRIDGE FOR A SUBCALIBER BARREL SYSTEM

FIELD OF THE INVENTION

The invention concerns an adaptive cartridge for a subcaliber barrel system for the discharge of subcaliber ammunition out of a large caliber weapon barrel with a centrally placed cartridge bearing and a coaxially subordinated percussion pin case, that is connected on the locked side with the cartridge bearing through a molded closure and including a safety rod that is decentrally arranged axially parallel to the percussion pin that is arranged to receive the impact of a compression spring and which takes up a slide member.

BACKGROUND OF THE INVENTION

An adaptive cartridge for a subcaliber barrel system, of the aforementioned type is known from West German Publication 33 39 745 C2. By this known adaptive cartridge the firing pin moves mechanically against the adaptive cartridge pin under the impact of a compression spring. By this movement the firing pin pierces the percussion cap of a cartridge. For the mechanical ignition, kinetic energy will be required for the detonation of the ammunition. The release of the mechanical ignition takes place by means of the ignition device of the large caliber ammunition, that will be screwed in from behind the firing pin case. If this original primer is discharged, excess pressure build up in the firing pin case that accelerates the firing pin. This firing pin finally detonates the subcaliber ammunition mechanically.

With the discharge of the ignition device a strong combustion residue regularly results that dirties the percussion pin and can lead to a defect.

SUMMARY AND OBJECTS OF THE INVENTION

It is therefore an object of the invention to provide an adaptive cartridge of the type referred to above, so as to avoid dirtying through combustion residue.

According to the invention the slide member is gripped in a guide that has a driving connection with the firing pin, by which the closed breech mechanism contacts on the cap of the cartridge and an electrical firing energy from the weapon is maintained over a pin.

In a development of the invention the safety rod in the slide member can be movable in the direction of the cartridge through the locked breech mechanism under the impact of a compression spring. The slide member inside a bore in the percussion pin case is movable at a maximum until it is moved nearly against a back striking position of the safety ring.

In a still further development of the invention the guide member can be built out of an electrically non-conductive material. Further, the guide member of the ringnut for the engagement of the slide member can be provided, with its outer casing surface in a sliding cylindrical bore of the percussion pin case lying adjacent thereto.

With these inventive properties the combustion residue that dirties the firing pin and which may lead to a defect is basically avoided, as an electrical ignition is used. Moreover, the primer is also eliminated which leads to a noteworthy cost reduction. At this stage, the firing energy in this system will lead through the firing pin without resistance and fires the ignition of the subcaliber ammunition electrically. In order to avoid an unwanted ignition of the subcaliber ammunition through the induction currents in the firing pin, the entire firing pin is, with the help of the safety rod, arranged so as to be removable.

The advantages of the electrical ignition are many including no more dirtying, through combustion residue, occurs thereby avoiding defects resulting in a substantial reduction in costs.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only figure shows the adaptive cartridge for a subcaliber barrel system in cross section.

DETAILED DESCRIPTION OF THE PREFERRED EMBODIMENT

Referring to the drawings in particular, the invention embodied therein comprises an adaptive barrel of a subcaliber cartridge system for firing subcaliber ammunition such as cartridge 11 out of a large caliber weapon barrel The arrangement includes a centrally disposed cartridge bearing 3 which is supported by a tubular casing 2 and which is conected to a firing pin case 5 which is coaxial with the cartridge bearing The firing pin case 5 is positively connected to the cartridge bearing 3 at a locked side of the cartridge bearing 3 and the firing pin case 5 is connected to an end piece 7 which is in turn connected to the tubular casing 2.

A firing pin 9 having an end bordering the weapon breach mechanism 6 is provided with an axial firing pin extension 12 disposed in an axial bore defined by the firing pin case 5. A safety rod 17 is disposed in a safety rod axial bore 16 defined by the firing pin case 5. Firing pin case 5 defines a radial bore 23 connecting the firing pin axial bore 8 and the safety rod axial bore 16. A guide member 13 is disposed in the firing pin axial bore 8 connected to the firing pin axial extension 12. A safety member 22 is connected to the safety rod 17 and is connected to the guide member 13 for moving the axial extension firing pin 12 upon movement of the safety rod 17, the firing pin axial extension 12 receives electrical energy from the weapon via the firing pin 9.

The adaptive barrel 1 consists essentially of the tubular casing 2, preferably made of a synthetic material, the cartridge bearing 3, the cartridge bearing barrel 4, and the firing pin case 5. The cartridge bearing barrel 4 is situated in a coaxial arrangement to the cartridge bearing 3 in the direction of breech mechanism 6.

The cartridge bearing barrel 4 can be a connected extension of the cartridge bearing 3. It can likewise, according to the illustrated embodiment, be put into use as an isolated component, which is connected with the cartridge bearing 3 through a positive connection and a frictional contact connection which, for example, is connected through a front screw.

The cartridge bearing barrel 4 supports itself axially on the lock side end of the flange ring of adaptive cartridge 1. The firing pin case 5 possesses a central bore 8, in which the firing pin 9 and the firing pin spring 10 are placed.

In an axial extension of firing pin 9 firing pin 12 is provided extending in the direction of cartridge 11. An axially movable sliding guide 13 is guided, formed out of an electrically nonconductive material with its outer casing surface 14 in a cylindrical bore 15 of firing pin case 5. The guide 13 and axial extension firing pin 12 are provided situated in a flexible connection so that by an axial movement guide 13 and axial extension firing pin 12 will be taken along in the same direction. The safety rod 17 takes up the force of spring 10. The axial extension firing pin 12 is objected to the spring pressure of spring 10 on the cap 29.

Decentral to the firing pin 9 and in a parallel arrangement to the firing pin 9 an axially movable safety rod 17 is inserted into the cylindrical bore 16 of firing pin case 5. The safety rod 17 stands with its front end face 18 against a pressure spring 19, so that an axial extension of the cylindrical bore 16 is provided for in the sack bore 20.

In its end area 21 the safety rod 17 is connected to a slide member 22 in a solid connection in which a radial bore 23 is movable at a maximum against a front striking position 24 and a back striking position 25. The slide member 22 grips the guide 13 with a tip end 26 in ringnut 27 through which a solid, flexible coupling exists between safety rod 17 and firing pin 12.

With the open breech mechanism 6 the safety rod 17 stands with its locked side end 28 out of firing pin case 5 under the strength of spring 19. The striking position towards the back is over the guide 13 and safety ring 30. In this position the firing pin 12 is also disposed away from the cartridge 11 in the direction of the breech mechanism 6. By a closing of the locks the safety rod 17 in firing pin case 5 will be pressed against the strength of spring 19. By means of the slide member 22 the guide 13 will now also be shoved towards the front in the direction of cartridge 11 and take axial extension firing pin 12 along with it until it borders on the cap 29 of the subcaliber cartridge that is under spring pressure via spring 10.

By this arrangement the connection between the firing pin and the igniter is also produced The electrical ignition occurs in the usual manner in the breech mechanism, where an electrical impulse on firing pin 9 and from those on the axial extension firing pin 12 will be transmitted. Through the insertion of electrically nonconductive material the electrical impulse from the guide 13 can be prevented from being spread onto the safety rod.

After a shot occurs, the breech mechanism 6 opens so that the safety rod 17 can again fall back into the starting position. In addition, firing pin 12 will likewise be withdrawn, pulling back and disconnecting the contact.

While a specific embodiment of the invention has been shown and described in detail to illustrate the application of the principles of the invention, it will be understood that the invention may be embodied otherwise without departing from such principles.

What is claimed is:

1. An adaptive barrel of a subcaliber barrel system for firing subcaliber ammunition out of a large caliber weapon barrel, comprising:

a tubular casing;

a centrally disposed cartridge bearing connected to said tubular casing and defining a central cavity for positioning subcaliber ammunition cartridge within the adaptive barrel;

a firing pin case positioned adjacent said cartridge bearing, coaxial therewith, said firing pin case being positively connected to said cartridge bearing at a lock side of said cartridge bearing;

a firing pin having an end bordering a weapon breech mechanism with an axial extension adjacent a cap of a cartridge, said firing pin disposed in an axial bore defined by said firing pin case;

a safety rod disposed in a safety rod axial bore defined by said firing pin case, said firing pin case defining a radial bore connecting said firing pin axial bore and said safety rod axial bore;

a guide member disposed in said firing pin axial bore connected to said firing pin axial extension; and, a slide member connected to said safety rod and connected to said guide member for moving said slide member and said guide member and in turn for moving said axial extension into and out of contact with the cap of said cartridge upon movement of said safety rod, said firing pin axial extension receiving electrical energy from the weapon via said firing pin.

2. An adaptive barrel according to claim 1, wherein said safety rod and said slide member are moveable in the direction of the cartridge by said breech mechanism, against the force of a pressure spring urging said safety rod in the direction of said breech mechanism, said slide member sliding within said radial bore of said firing pin case.

3. An adaptive barrel according to claim 1 wherein a safety ring is provided restricting the movement of the guide member thereby restricting the movement of the slide member in the direction of the breech mechanism.

4. An adaptive barrel according to claim 1 wherein said guide member is of electrically non-conductive material.

5. An adaptive barrel according to claim 1 wherein said guide member is provided with a ring portion engaging said slide member, said guide member having an outer portion lying adjacent a cylindrical extension of said firing pin axial bore.

* * * * *